United States Patent [19]

Varga

[11] Patent Number: 4,922,579

[45] Date of Patent: May 8, 1990

[54] CONTROLLING CARDING MACHINES

[75] Inventor: John M. J. Varga, Halifax, England

[73] Assignee: Carding Specialists, (Canada) Ltd., Ontario, Canada

[21] Appl. No.: 187,375

[22] Filed: Apr. 28, 1988

[30] Foreign Application Priority Data

Apr. 29, 1987 [GB] United Kingdom ..... 8710162

[51] Int. Cl.[5] ..... D01G 15/40

[52] U.S. Cl. ..... 19/105

[58] Field of Search ..... 19/98, 99, 105, 106 R, 19/240

[56] References Cited

U.S. PATENT DOCUMENTS

| | | | |
|---|---|---|---|
| 3,644,964 | 2/1972 | Varga | 19/240 |
| 3,925,850 | 12/1975 | Lytton | 19/98 |
| 4,271,565 | 6/1981 | Grunder | 19/240 |
| 4,275,483 | 6/1981 | Roberson | 19/240 |

*Primary Examiner*—Werner H. Schroeder
*Assistant Examiner*—D. Price
*Attorney, Agent, or Firm*—Darby & Darby

[57] ABSTRACT

A carding machine comprises a feed plate, a feed roll forming a nip with the feed plate, first drive means for rotating the feed roll, a takerin for taking fibre from the feed plate, a main carding cylinder, carding means co-operable with the main carding cylinder to effect a carding action, a doffer, and delivery means for taking carded fibre from the doffer and delivering it from the machine. In one form of the machine, means are associated with the feed roll for producing an output signal related to deviation in weight of material fed between the feed roll and the feed plate, the sensing means being means for monitoring a variable at the feed roll that is other than displacement relative to the feed plate, and means are responsive to the output signal to control the speed of the feed roll. In a second form of the machine sensing means respond to a dynamic variable on the carding machine occurring downstream of the feed roll but upstream of the doffer, to produce an output signal related to deviation in weight of material fed between the feed roll and the feed plate, and means are responsive to the output signal to control the speed of the feed roll.

10 Claims, 5 Drawing Sheets

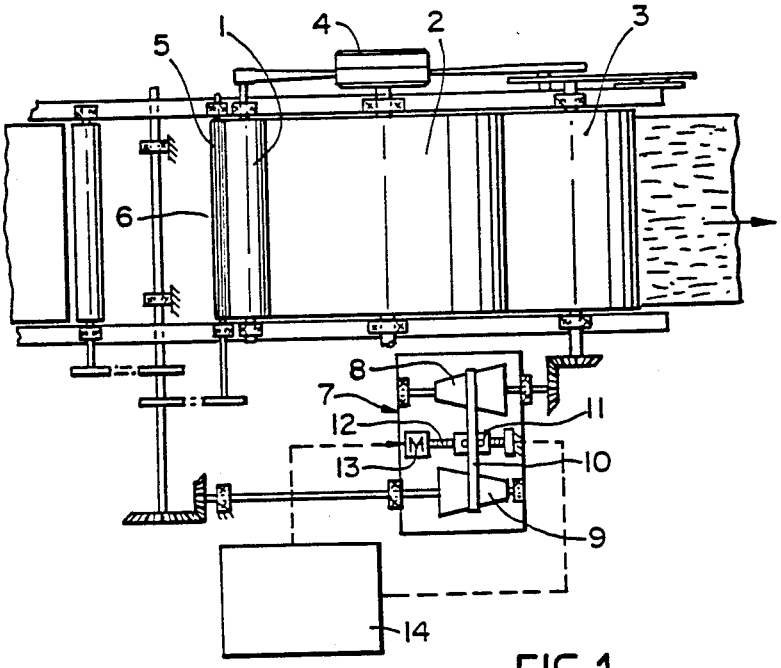
FIG.1.
FIG.2.
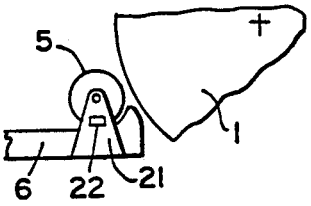
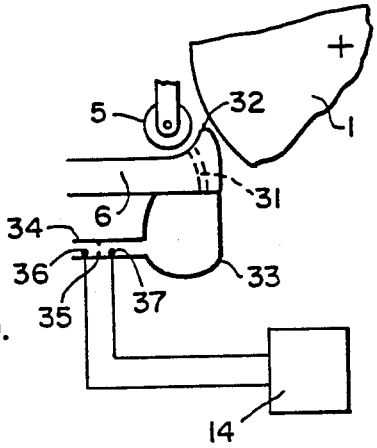
FIG.3.

CONTROLLING CARDING MACHINES

This invention relates to the control of a carding machine.

The importance of being able to obtain a uniform sliver from the carding process is well recognised. Any significant deviation of weight per unit length of sliver will be translated into corresponding deviations in the yarn formed from the sliver and in fabric products from that yarn. Accordingly, it is a general objective of the carding industry to achieve very low deviations from a given mean weight per unit length of sliver.

There have been many proposals for controlling a carding machine in order to improve sliver uniformity. As is discussed at length in US-A-4275483 the prior systems may be divided into so-called "after-card regulators" which monitor a characteristic of the web or sliver delivered from the carding machine and relate to weight per unit length of sliver and use such monitoring to control the speed of the feed roll of the carding machine as required to hold said characteristic constant, and so-called "before-card regulators" which monitor some characteristic of the bat or lap of fiber fed to the card, using deviations from a given value to regulate the rate of feed. Feed of fiber into the carding machine is effected by a rotating feed roll that forms a nip with a feed plate, and US-A-4275483 describes a method of card control by sensing movement of the feed roll generally along a line of displacement relative to the feed plate in response to the amount of fibrous material nipped between the feed roll and feed plate. If greater amounts of fiber move through the nip then the feed roll tends to move away from the feed plate and the displacement is used to control deceleration of the feed roll so that the feed rate per unit time remains substantially constant. Similarly, if lesser material passes between the feed roll and the feed plate then the feed roll tends to move towards the feed plate and such displacement is utilised to accelerate the feed roll. This forms an open loop control system designed to maintain constant the rate of feed of material to the carding machine in order that the sliver weight per unit length delivered from the machine also remains constant.

The present application is concerned firstly with methods of sensing deviations of feed rate in the region of a feed roll that are different from, and improvements in, the method disclosed in US-A-4275483, and secondly with a totally novel concept for the control of a carding machine that differs radically from the aforesaid proposal and from other systems already known in the prior art. These two topics will be discussed separately.

Dealing firstly with sensing in the region of the feed roll, a first of the inventions disclosed herein comprises sensing deviation in weight of material fed between a feed roll and a feed plate by monitoring a variable other than displacement of the feed roll along a line of displacement relative to the feed plate, and utilising a signal from such monitoring to control the speed of the feed roll.

BRIEF DESCRIPTION OF THE DRAWINGS

FIG. 1 is a schematic plan view illustrating a carding machine and control apparatus therefor;

FIG. 2 is an enlarged elevation showing a first feed roll arrangement;

FIG. 3 is an enlarged elevation showing a second feed roll arrangement with associated control equipment.

FIG. 1 shows a schematic plan view of a conventional carding engine having a takerin 1 a main carding cylinder 2 and a doffer cylinder 3 all driven from an electric motor 4. A feed roll 5 cooperates with a feed plate 6 to feed material to be carded to the the takerin 1. The feed roll is driven from the doffer 3 through a drive system that includes a speed variator 7, shown as being of a conventional cone drive type. The variator includes an input cone 8 driven from the doffer and an output cone 9 driving to the feed roller 5, a belt 10 transmitting drive between the input and output cones. The belt can be shifted by a belt shifter 11 movable to the left or right as shown in the Figure by a lead screw 12 rotatable by a motor 13 operating in response to a controller 14. Movement of the belt will control the transmission ratio between the two cones and thus vary the speed of the feed roll 5 relative to the doffer 3. Such variations are effected in response to variation of the weight of material passing between the feed roll and feed plate at any given time, and the embodiments of the invention whereby the required control signals may be derived will now be described.

As shown in FIG. 2 in a first embodiment the feed roll 5 is journalled to rotate in bearings mounted in side supports 21 that are secured to the feed plate 6. At each side of the feed roller 5 the support 21 incorporates a strain gauge 22, each strain gauge providing a continuous read-out signal to an electronic circuit embodied in the controller 14. It will readily be seen that the strain in the side supports 21 will vary in accordance with the thickness of material passing between the feed roll and the feed plate. The signals from the two strain gauges are added and the controller 14 may be zeroed at a position wherein the sum represents a given required thickness of material. A greater instantaneous thickness of material will increase the strain, the summed value being proportional to the thickness, and that value is then used to drive the belt shifter in a direction such that the speed of the feed roll is reduced. Similarly, as the thickness reduces then the strain is reduced and the belt shifter will be moved in a direction such that the feed roll is accelerated. Immediate correction of feed roll speed is thus made in accordance with variations in thickness of material being fed by the feed roll.

Figure 4:
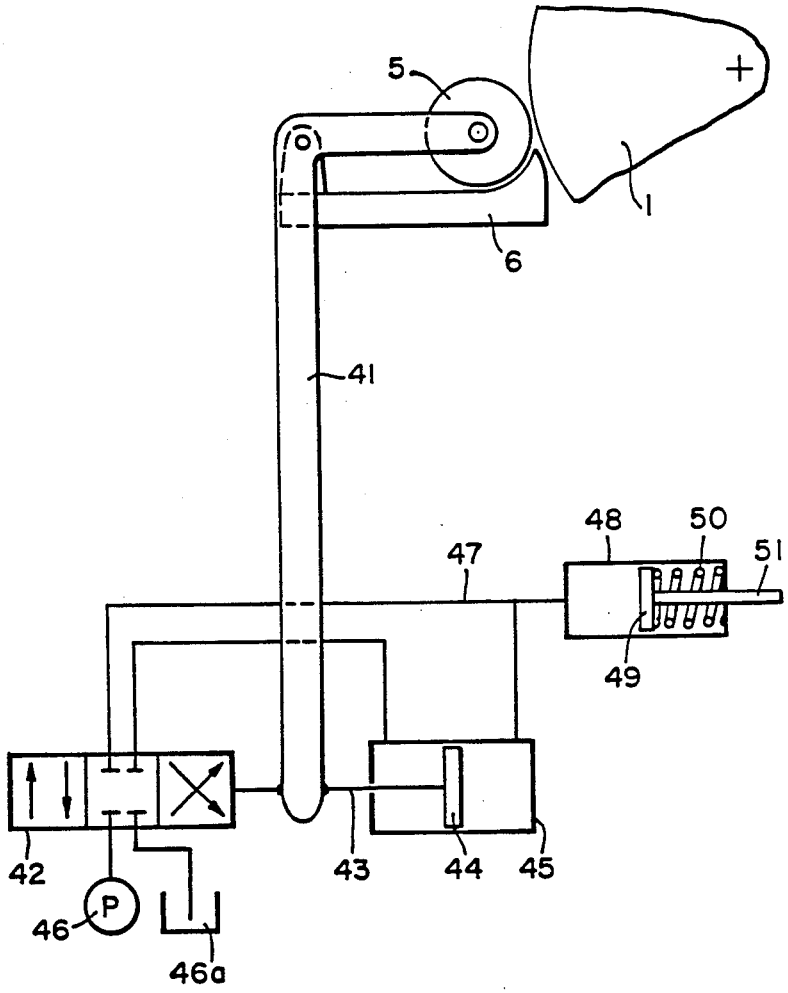
FIG. 4 is an enlarged elevation showing a third feed roll arrangement together with associated control equipment.

In the embodiment shown in FIG. 3 the feed roll 5 is supported in any suitable manner to rotate adjacent to the feed plate. The feed plate is formed with a number of in line air passages 31 directed to open from the upper surface of the feed plate in a direction substantially radially of the feed roll at a location as close to the nose 32 of the feed plate as possible. A plenum chamber 33 is secured to the lower part of the feed plate and an air line 34 feeds air into the plenum chamber. The air line includes a restriction 35 and pressure transducers 36 and 37 are provided both upstream and downstream of the restriction. In operation, if the air line is fed with air at constant pressure and if the resistance to air presented by material passing between the feed roller and the feed plate remains constant then there will be a constant pressure drop over the restrictor 35. However, if the amount of material between the feed roller and the feed plate increases then the resistance to air flowing from the passages 31 will increase and the back pressure in the plenum chamber will also increase. The pressure difference between transducer 36 and 37 will change and that change may be used by the controller 14 to control the feed roll so that its speed is reduced. Similarly, if the thickness of material is reduced then the resistance to air flow from the passages 31 will reduce, the pressure difference will change and this change will be used by the controller to increase the speed of the feed roll.

In the arrangement shown in FIG. 4 the feed roll 5 is supported for rotation in bearings at the end of lever arms 41, one at each side of the apparatus. The lever arms 41 are each connected to the spool 42 of a respective spool valve and to the piston rod 43 of a piston 44 acting in a double-acting cylinder 45. Fluid from a pump 46 may be supplied to the cylinder under control of the spool valve, and returned to drain 46*a*. Fluid line 47 is connected to a further cylinder 48 in which there is a piston 49 biased against the fluid pressure by a compression spring 50. Movement of the piston rod 51 at each side of the apparatus is transmitted to the controller 14, the two movements are added and are used to control shifting of the belt in the cone drive.

In operation, if a thicker section of lap occurs the fed roll will tend to move away from the feed plate. This will move the spool 42 of the valve to feed fluid to the right of the piston 44 as seen in FIG. 4, so returning the feed roll to its original position against the separating force. The increased pressure in line 47 will cause movement of the piston rods 51, which will control the belt shift so that the feed roll is decelerated to compensate for the greater thickness. Opposite control will occur when a reduced thickness is experienced.

Other systems will be apparent, that are capable of responding to variations in thickness of fiber passing between the feed roll and the feed plate, and that are not dependent on measuring movement of the feed roller transversely of the feed plate.

The following part of the description now concerns itself with the second inventive concept. It will be recalled from the introduction that previous control systems have been divided into two groups, after-card regulators and before-card regulators. The feed roll systems shown in FIGS. 2 to 4 are, of course, before-card regulators. Although these may show some advantages over after-card regulators, nevertheless it has now been realised that measurement is still not taking place at the ideal location. Thus, if overfeed or underfeed is sensed at the feed roll, and a resulting correction applied very rapidly to the feed roll, then correction is occurring before the section of wrong fiber weight actually reaches the carding machine, and this in itself is a potential cause of error. One prior art arrangement is known which addresses this problem; the so-called Uster M-controller which utilizes an optical measuring unit for checking relative cross-sectional variations of fiber on the card clothing of the main cylinder, and responds to such variations to change feed roller speed as required. This is, however, a complex and expensive arrangement.

According to the second aspect of this invention, therefore, a dynamic variable on the carding machine itself and related to sliver weight per unit length is measured, and variations in such measurement are used to control the speed of a feed roll for the carding machine. Thus, the amount of material actually taken into or fed through the carding machine is used to produce a control signal, and errors that may arise between a before-card regulator and the card itself can be eliminated.

Preferably the dynamic variable that is sensed is the power consumption of the takerin. This is directly related to the weight of material that is drawn by the takerin from the nose of the feed plate and the sensing signal is thus obtained in exactly the optimum location. Change of feed rate occurs at the point of release of fiber, from the feed roll, i.e. at the nose of the feed plate, and by sensing at the nose the points of sensing and of adjustment are made as nearly coincident as possible. In addition to an adjustment derived from power consumption it may also be necessary to apply an additional correction factor related to the speed of the takerin, and production rate.

In an alternative embodiment the dynamic variable measured is the power consumption of the motor driving the carding cylinder, or the drag experienced at the circumference of the carding cylinder. These are both directly related to the weight of material on the cylinder, and are again accurately related to the weight per unit length of the sliver formed by the carding machine. When power consumption is used as the variable it may again be necessary to apply a correction for speed variation.

Figure 5:
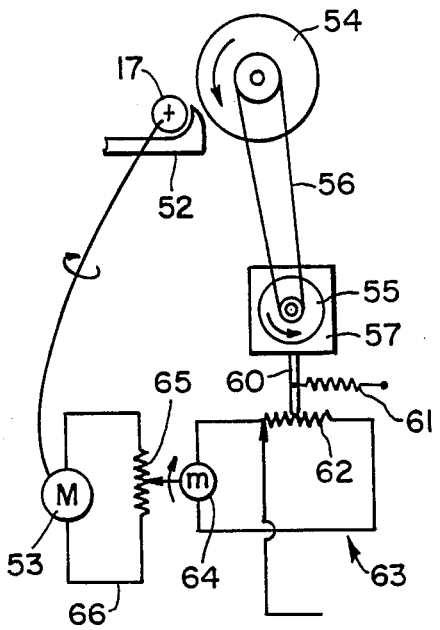
FIG. 5 is a schematic representation of a first embodiment.

Referring now to FIG. 5 there is shown a feed roll 51 and feed plate 52. The feed roll is mounted for rotation in any convenient manner and is driven by a motor 53. The takerin 54 of the card is mounted adjacent to the feed plate, and can rotate on the card frame in the usual manner. However, rather than drive the takerin from the carding cylinder it is, in this embodiment, driven from a separate motor 55 by a belt 56. The motor is mounted on a cardle 57 which is supported in bearings 58 from stub shafts 59 secured to a cage 59*a* that is fixed to the frame of the carding engine. An arm 60 projects from the lower part of the cradle and is biased anti-clockwise as seen in FIG. 5 by a tension spring 61. The arm 60 is linked directly to a potentiometer 62 included in a circuit 63 capable of providing current to a reversible motor 64. The motor 64 drives a lead screw which controls the movable element of a further potentiometer 65 included in a circuit 66 providing current to the motor 53.

The apparatus is set up so that when running normally the takerin 54, rotating at a given constant speed, is taking a given weight of fiber per unit time from the nose of the feed plate 52 and is thus applying a given torque on the motor 55. This causes the cradle 57 to pivot in its bearings to a position related to the torque, against the action of the spring 61. In the steady state this position of the finger 60 corresponds to the center position of the potentiometer 62 and there is zero current in the circuit to motor 64, which is accordingly stationary. Motor 53 is rotating at its normal set speed. If, now, a thicker section of feed stock is presented at the nose of the feed plate to the takerin 54 the torque on the motor 55 will increase and the arm 60 will pivot further anti-clockwise as seen in FIG. 5, against the action of the spring 61. The potentiometer 62 will be moved from its center zero position to the left and current will be fed to the motor 64. This motor will rotate in a sense causing the resistance of potentiometer 65 to increase, thus causing the speed of motor 53 to decrease so reducing material feed. The overfeed is thus very rapidly corrected.

When correct feed thickness is again established past feed roll 51 the now slower speed of this roller will cause a lower weight of fiber per unit time to be presented to the takerin and thus less fiber will be taken from the nose of the feed plate. The torque on the takerin will accordingly reduce, the arm 60 will move clockwise as shown in FIG. 5 and a reverse current will be established in circuit 63 so that the motor 64 is driven in a direction to reduce the resistance of potentiometer 65 and thus accelerate the motor 53 and feed roll 51. It will be seen that the speed of the feed roller motor is increased or decreased at a rate that is dependent on the deviation of the torque from the normal level, and thus that a closed loop control system is established, which system has a very rapid response rate.

In an alternative to the arrangement shown, the torque of the takerin may be measured electronically (for example by measuring the wattage of motor 53) and a signal derived from that measurement may be used directly to control the current to the motor 53 and thus the speed of the feed roller 51. The cradle and cage mounting described is thus not required. This is an example of using the system in an open loop mode. In another arrangement wherein the cradle and cage can again be omitted, a rotary encoder can be included on the shaft of motor 55 in order to measure motor slip and thus give a function of the torque. A signal from the encoder may be used either to control a dual potentiometer circuit as shown in FIG. 5, or directly to control current to the motor 53.

Figure 7:
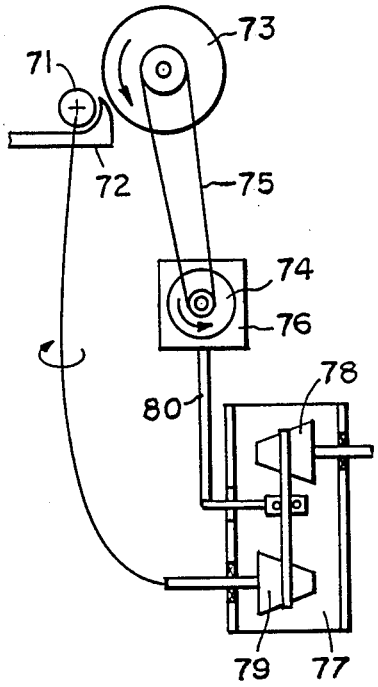
FIG. 7 is schematic side elevation of a further embodiment.
Figure 6:
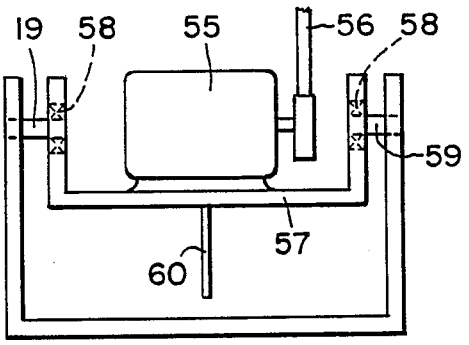
FIG. 6 is a detail of a motor mounting used in FIG. 5.

FIG. 7 shows schematically a system comprising a feed roll 71, feed plate 72, takerin 73 and motor 74 driving the takerin through a belt 75. A torque-dependent signal from the takerin motor 74 or from a mounting 76 for that motor is used to control the belt shifter of a cone belt drive 77, having an input drive cone 78 driven from the calender rolls of the carding machine, and an output cone 79 driving the feed roller 71. Drive to the belt shift may be a direct mechanical drive from the arm 80 of a motor cradle, or the belt shift may be driven from a lead screw rotated by a motor as shown in FIG. 1, rotation of the motor being controlled by a signal derived from movement of the arm 80 or derived electronically in response to motor torque. The system shown in FIG. 7 is an open loop control system, but again has the advantage of being dependent on the amount of material actually loaded onto the takerin.

Figure 8:
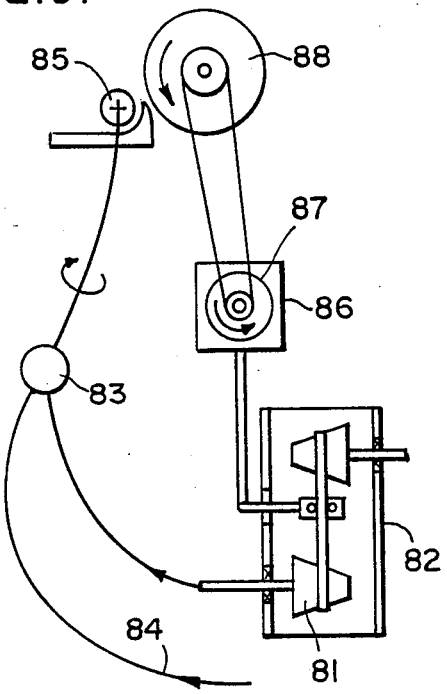
FIG. 8 is a schematic side elevation of yet another embodiment.

FIG. 8 shows schematically a system that combines open loop and closed loop control. The system comprises a feed roller 71, feed plate 72, takerin 73, and motor 74 driving the takerin through a belt 75, all as shown in FIG. 7. The motor has a mounting 76. The drive from the output cone 81 of a cone drive system 82 controlled in the same way as that shown in FIG. 7 is fed to a differential 83, which also receives drive 84 direct from an autoleveller as described in US-A-3644964. The two drives are added together in the differential and the sum of the drives is applied to the feed roller 71.

Figure 9:
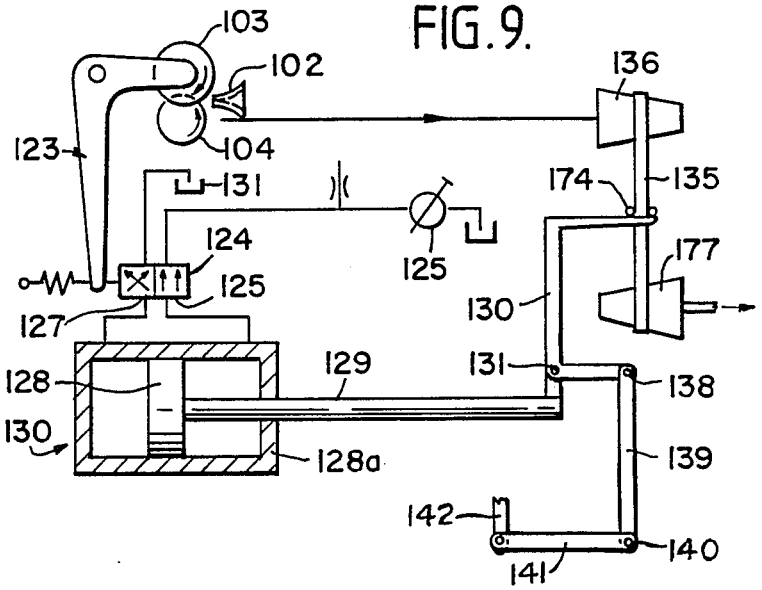
FIG. 9 shows detail of one practical realization of the FIG. 8 embodiment.

FIG. 9 shows one practical way in which the concept of FIG. 8 can be realised. The carded web taken from the doffer of the carding machine is fed to a condensor trumpet 102 and through a pair of tongue and groove measuring rollers 103 and 104, which may form part of a calender arrangement. The roller 103 is rotatably carried by one element of any suitable lever system indicated generally at 123, for example as described in US-A-3644964. The lever system is such that it produces a magnified movement at the end of the system, which movement is transmitted to a spool of a spool valve 124 controlling flow of low pressure fluid from a pump 125 driven directly from the doffer drive. The spool valve has two outlet ports 126 and 127 which are connected to pass fluid to opposite sides of a piston 128 working in a cylinder **128*a* of a fluid motor 130. The valve also has a connection to drain 131. The piston 128 has a piston rod 129, to the end of which a lever 130 is connected by a pivot 131. The longer arm of the lever 130 is connected to a belt shift 134 for shifting the belt 135 of a cone belt drive having an input drive cone 136 driven from the calender, and an output drive cone 137 connected to drive the feed roller 85**.

The shorter arm of the lever 130 is pivotally connected at 138 to a connecting arm 139 pivoted at 140 to a lever 141 also pivoted at its other end an arm 142 attached to the cradle 86 of the drive motor 87 for the takerin 88.

In operation the system will be set up to suit the particular carding operation to be carried out, and will be designed to produce a sliver of a given count in response to a given rate of transfer of fiber onto the takerin and thus a given torque experienced by the takerin drive motor. Under theseconditions the parts are in the positions shown in FIG. 9, with the belt 135 in its center position on the two pulleys, so driving the feed roll at a given ratio of calender speed.

If, during running, the takerin continues to take a constant weight per unit time of fiber from the feed plate and if the sliver count stays at the required value then no adjustments will occur within the system. If, however, there is a deviation in the rate at which material is taken from the feed plate by the takerin then the torque on the takerin motor will either increase or reduce and movement of the arm 141 and rod 139 will cause lever 130 to pivot about pivot axis 131 so moving the belt on the drive cones. An increased torque experienced by the takerin motor will cause belt movement in a sense that will reduce the speed of the feed roller; conversely a reductiion in torque will cause movement in a belt in a direction such that the feed roller speed is increased. Variations in feed roller loading are thus very rapidly compensated for by this open loop system.

Compensation is also effected for variations in sliver thickness. Should the count of the sliver increase then valve 124 will be operated to allow the pump 125 to pump fluid into the cylinder **128*a* to extend the piston 128, so moving the drive belt 135 to reduce the transmission ratio and slow down the feed roll. The reduced rate of feed will cause sliver thickness to reduce towards the required value. Consequently, reduction in sliver thickness below the required value will cause fluid to be fed into cylinder 128*a* to retract the piston 128, so moving the drive belt 135 in a sense that will increase the transmission ratio to the feed roll 1** and speed up that feed roll.

It will be understood that by connecting the fluid-operated motor 130 in series with the torque-responsive system the effect of sliver thickness errors as detected by tongue and groove rollers 103 and 104 will be added to the effect of lap feed variations detected at the takerin, and the cumulative effect will be used to adjust the rate of feed by adjusting the speed of the feed roll. Good control of sliver count is effected thereby, particularly as the closed loop control from sensing of sliver thickness compensates for and prevents drift of the open loop control sensing at the takerin.

The systems described in FIGS. 5 to 9 are all responsive to torque variations at the takerin. It will be understood that similar systems may be used that are responsive to torque on the motor driving the carding cylinder. Thus, the cylinder motor may be mounted in a cardle, may have a wattmeter applied thereto or may also drive an encoder in order that a signal may be derived and applied to control speed of the feed roll.

Torque at both the takerin and the carding cylinder are dependent on their speeds, which are set to suit the required carding conditions. This has to be taken into account when calibrating the machine, and a speed-related correction applied to the system. Torque will also change when, for a given sliver weight, the production rate of the machine is changed. Speed of the doffer or calender rolls then changes and a correction factor derived therefrom may be used to change the zero point and acceleration characteristics in the FIG. 5 embodiment, by known microchip means. Similar corrections may be applied in the other described embodiments.

Figure 10:
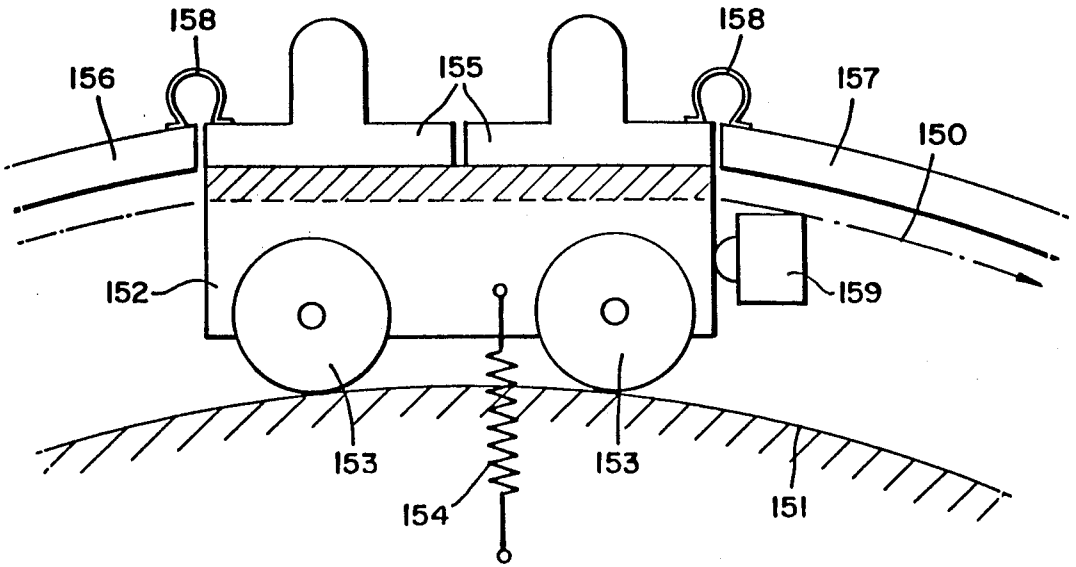
FIG. 10 is a schematic elevation of a final embodiment.

FIG. 10 also shows a system that relies on sensing carried out on the main carding cylinder. In that Figure the cylinder is shown at 150, and at each side of the cylinder there is a bend 151 as will be familiar to those skilled in this field. At one region around the circumference of the cylinder a carriage 152 is supported by wheels 153 on the bends at each side of the cylinder, and is held against the bends by tension springs 154. The carriage has two flats 155 bolted thereto, the flats having carding elements that cooperate with the carding elements on the cylinder in known manner. The flats lie between two fixed plates 156, 157 secured in any convenient manner to the card, and spaces between the flats and the plates are sealed by flexible seals 158. At each side of the cylinder there is a transducer 159 against which an end of the carriage 152 bears.

It will be seen that as the cylinder is rotated clockwise as shown in FIG. 10 the effect of the fibers between the cylinder and the flats will be to tend to drag the flats in a clockwise direction, the amount of force applied to the flats being dependent on the weight of fiber loaded onto the cylinder. The force on the flats is sensed by the transducer 159 and the signals from the transducers may be used to control the speed of the feed roll in any of the systems already described.

In any of the systems described means may be provided for stopping the feed roll or any other of the elements of the carding machine if the torque sensed at the takerin or the main carding cylinder, or the force experienced at transducers 159 exceeds a given value indicative of a fault condition.

Other modifications may be made, and other systems based on the principles described herein will be apparent. In particular, any of the described embodiments may effect control in response both to a variable at the feed roll or dynamic variable downstream of the feed roll and to a signal responsive to variations in sliver thickness at tongue and groove rollers at the delivery end of the machine. FIG. 9 gives an example of this dual control, but it will be understood that a signal from the tongue and groove rollers, generated in any convenient way, may be superimposed on the controller 14 of the before-card regulators of FIGS. 1 to 4, or on any suitable part of the after-card regulators of FIGS. 5 to 7 and 10.

I claim:

1. A carding machine comprising a feed plate, a feed roll forming a nip with the feed plate, first drive means for rotating the feed roll, a takerin for taking fiber from the feed plate, a main carding cylinder, carding means cooperable with the main carding cylinder to effect a carding action, a doffer, delivery means for taking carded fiber from the doffer and delivering it from the machine, sensing means responsive to the power consumption of the takerin for producing an output signal related to deviation in weight of material fed between the feed roll and the feed plate, and means responsive to the output signal to control the speed of the feed roll.

2. A carding machine according to claim 1 in which second drive means are provided for driving the main carding cylinder and third drive means separate from the second drive means are provided for driving the takerin, the third drive means comprising a cage, means fixing the cage to a frame of the carding machine, a cradle, means pivotally mounting the cradle in the cage about an axis parallel to the axis of rotation of the takerin, means biasing the cradle towards a rest position relative to the cage, a motor secured to the cradle, and transmission means linking the motor to the takerin, and in which the sensing means is means responsive to pivotal movement of the cradle relative to the cage.

3. A carding machine according to claim 2 in which the sensing means comprises a variable potentiometer having a movable member for varying the resistance of the potentiometer and means linking the movable member to the cradle to move in response to pivotal movement of the cradle, and the output signal is, or is derived from, the resistance of the potentiometer.

4. A carding machine according to claim 2 in which the first drive means is linked to the second drive means by a variable speed transmission, and in which the sensing means is effective to vary the transmission ratio of the variable speed transmission.

5. A carding machine according to claim 4 in which the variable speed transmission comprises an input drive cone, an output drive cone, a belt transmitting drive between the two cones and shift means for shifting the belt axially of the drive cones to vary the transmission ratio therebetween, and in which the sensing means is means linking the cradle to the shift means to shift the belt in response to pivotal movement of the cradle relative to the cage.

6. A carding machine according to claim 1 in which the delivery means includes means for condensing the carded fiber to a sliver, further sensing means responsive to variations in the count of the sliver for producing a further output signal related to deviation of sliver count from a preset value, and means responsive to the further output signal to superimpose further control on the speed of the feed roll in addition to control effected in response to the power consumption of the takerin.

7. A carding machine comprising a feed plate, a feed roll forming a nip with the feed plate, first drive means for rotating the feed roll, a takerin for taking fiber from the feed plate, a main carding cylinder, carding means cooperable with the main carding cylinder to effect a carding action, a doffer, delivery means for taking carded fiber from the doffer and delivering it from the machine, sensing means responsive to the power consumption of the main carding cylinder for producing an output signal related to deviation in weight of material fed between the feed roll and the feed plate, and means responsive to the output signal to control the speed of the feed roll.

8. A carding machine according to claim 7 in which the delivery means includes means for condensing the carded fiber to a sliver, further sensing means responsive to variations in the count of the sliver for producing a further output signal related to deviation of sliver count from a preset value, and means responsive to the further output signal to superimpose further control on the speed of the feed roll in addition to control effected in response to the power consumption of the main carding cylinder.

9. A carding machine comprising a feed plate, a feed roll forming a nip with the feed plate, first drive means for rotating the feed roll, a takerin for taking fiber from the feed plate, a main carding cylinder, carding means cooperable with the main carding cylinder to effect a carding action, a doffer, delivery means for taking carded fiber from the doffer and delivering it from the machine, sensing means responsive to drag at the circumference of the main carding cylinder for producing an output signal related to deviation in weight of material fed between the feed roll and the feed plate, and means responsive to the output signal to control the speed of the feed roll.

10. A carding machine according to claim 9 in which the delivery means includes means for condensing the carded fiber to a sliver, further sensing means responsive to variations in the count of the sliver for producing a further output signal related to deviation of sliver count from a preset value, and means responsive to the further output signal to superimpose further control on the speed of the feed roll in addition to control effected in response to drag at the circumference of the main carding cylinder.

* * * * *